US010143318B2

(12) United States Patent
Shaffer et al.

(10) Patent No.: US 10,143,318 B2
(45) Date of Patent: Dec. 4, 2018

(54) FOOD DISPLAY AND SERVICE ARTICLES

(71) Applicant: Selfeco LLC, Stillwater, MN (US)

(72) Inventors: Chadwick Aaron Shaffer, Oakdale, MN (US); Daniel George Mishek, Roseville, MN (US)

(73) Assignee: SELFECO LLC, Stillwater, MN (US)

( * ) Notice: Subject to any disclaimer, the term of this patent is extended or adjusted under 35 U.S.C. 154(b) by 39 days.

(21) Appl. No.: 14/658,931

(22) Filed: Mar. 16, 2015

(65) Prior Publication Data

US 2016/0206121 A1 Jul. 21, 2016

Related U.S. Application Data

(60) Provisional application No. 62/105,040, filed on Jan. 19, 2015.

(51) Int. Cl.
*A47G 19/06* (2006.01)

(52) U.S. Cl.
CPC ..... *A47G 19/06* (2013.01)

(58) Field of Classification Search
CPC .. A47G 19/06; A47G 21/145; B65D 21/0209; B65D 51/246
USPC ..... 220/574.1, 710, 735
See application file for complete search history.

(56) References Cited

U.S. PATENT DOCUMENTS 2,885,134 A * 5/1959 Cohen ..... A47G 19/2266 206/515
3,288,344 A * 11/1966 Woollen ..... A47G 19/065 206/217
3,648,369 A * 3/1972 Frodsham ..... A47G 21/181 30/141
D330,141 S * 10/1992 McNerney ..... D7/300.2
5,558,247 A * 9/1996 Caso ..... B65D 83/303 220/735
5,798,436 A 8/1998 Gruber et al.
8,464,896 B2 * 6/2013 Beary ..... A47G 19/2222 220/705
2012/0145571 A1 * 6/2012 Feldmann ..... B65D 1/0223 206/217
2012/0285845 A1 * 11/2012 Jackson ..... A47G 19/186 206/223
2015/0197366 A1 * 7/2015 Chapin ..... B65D 85/72 220/254.1

* cited by examiner

*Primary Examiner* — Andrew T Kirsch
*Assistant Examiner* — Don M Anderson
(74) *Attorney, Agent, or Firm* — Kagan Binder, PLLC

(57) ABSTRACT

Service items and utensil combinations are provided for efficiency of food service and for selective presentation of foods. Service items include at least a side wall defining an inside surface for receiving food, wherein the side wall is provided with an indentation that extends at least partially over a width of the sidewall for defining a utensil receiving recess along an outside surface of the sidewall, and a recessed edge portion provided along a peripheral edge of the sidewall providing access to the utensil receiving recess. The recessed edge portion can be defined by an edge portion of the peripheral edge and a plurality of opposed capture points. One or more utensils are provided in combination with the service item, wherein each utensil has a portion thereof that is dimensioned to be supported on the edge portion defining the recessed edge portion adjacent to the opposed capture points.

16 Claims, 15 Drawing Sheets

FOOD DISPLAY AND SERVICE ARTICLES

CROSS REFERENCE TO RELATED APPLICATION

This application claims the benefit under 35 U.S.C. § 119(e) of U.S. Provisional Patent Application No. 62/105,040, filed Jan. 19, 2015 and titled "Food Display and Service Articles", which is incorporated herein by reference in its entirety.

FIELD OF THE INVENTION

The present invention is directed to food service items, such as plates, dishes, bowls, and the like that are fabricated from plastics and that include features for food service efficiency and presentation.

BACKGROUND

Disposable service articles for food and drink have been developed to provide convenience for consumers. Food is sometimes sold in disposable containers from grocery stores and restaurants, and many different disposable food and drink service articles are available for use by consumers for the convenience of serving food and drinks without having to clean and care for permanent service items. Fast food establishments offer food and drink "to go" to consumers, and such products are almost always provided in some sort of disposable container. Paper service articles have been around for a long time, but suffer in general as to durability. Plastic articles have also been developed for better durability, but such plastics add to the amount of plastic waste to be dealt with either through disposal or recycling.

In the case of providing food and drink service to a large group of people at an event or the like, such as by a catering service, it can be more convenient to set out portions of food as provided on a disposable service item. With most foods, it is also desirable to conveniently provide one or more types of utensils nearby the food and service items. Problems can occur in coordinating the provision of the utensils and the food service items by either proximity or by quantity. Moreover, with unpackaged utensils set out for picking by the consumers, the utensils are potentially handled by many different consumers providing less sanitary conditions than individual packaged utensils.

At reception type events, it is common for consumers to browse and choose food items while walking about the reception and socializing with others. Thus, the consumers carry food about on a food service item while also potentially needing and using utensils. This can be problematic in how to store used or unused utensils while socializing with others. Consumers commonly store one or more utensils within a pocket coat, purse or the like until they are needed, but that is not an option once the utensil has been used. Other than setting used utensils on the food service item with remaining food or setting down the food service item and utensils, it is difficult to interact with others, such as to greet another by shaking hands and the like.

Food presentation can also be important in the food service industry. In catering certain events, for example weddings and the like, it may be undesirable to present food on disposable articles. But in many events, getting food to a large number of people efficiently necessitates the use of disposable items. Such service situations can include where food is sold individually to consumers or where food items are set out for the choosing by consumers, such as at a reception type event. It is very desirable in both of these situations to present the food in a manner appealing to the consumer. In the case of fast food service, where presentation is not always as important, certain items like deserts or the like might be preferred to be served in a more elegant or novelty way.

SUMMARY OF THE INVENTION

The configurations of the containers and service items of the present invention are particularly advantageous for efficient and pleasing presentation of food. In an embodiment, the containers and service items are manufactured from recyclable materials. This provides significant benefit in reduction of the amount of solid waste being deposited in landfills or inappropriately disposed of.

In an embodiment, the containers and service items are manufactured from biodegradable materials. This provides significant benefit in reduction of solid waste and convenience for the consumer. Specifically, because the material is biodegraded, there is no need to further process the used container to remove food remnants or other materials that are disadvantageous to a recycling process.

In one aspect of the present invention, a service item and utensil combination is provided for presentation of foods along with the combination wherein the combination includes the service item with at least a side wall defining an inside surface for receiving food, the side wall having an indentation that extends at least partially over a width of the sidewall for defining a utensil receiving recess along an outside surface of the sidewall, and a recessed edge portion provided along a peripheral edge of the sidewall providing access to the utensil receiving recess, the recessed edge portion defined by an edge portion of the peripheral edge and a plurality of opposed capture points; and the utensil including a portion thereof that is dimensioned to be supported on the edge portion defining the recessed edge portion adjacent to the opposed capture points.

Preferably, the recessed edge portion is defined within a shape that is defined by the peripheral edge of the service item. More preferably, the recessed edge portion is further defined by a portion of the peripheral edge that substantially follows the shape of the indentation that defines the utensil receiving recess, thus creating an open arc portion along with the plural capture points, and wherein the plural capture points are opposed to one another from opposed sides of the recessed edge portion.

In accordance with another aspect of the present invention, the service item can be prepared from an injection moldable material, a recyclable material, and/or a an injection moldable Biodegradable Plastic. A Biodegradable Plastic can be an Industrially Compostable Plastic, and can comprise an injection moldable polymer selected from the group consisting of polylactic acid polymer, polyhydroxyalkanoate polymer, starch based resin, cellulose esters, biobased polyethylene compounds, and mixtures thereof.

In another aspect of the present invention, a service item is provided for presentation of foods comprising at least a side wall defining an inside surface for receiving food, the side wall having an indentation that extends at least partially over a width of the sidewall for defining a utensil receiving recess along an outside surface of the sidewall, and a recessed edge portion provided along a peripheral edge of the sidewall providing access to the utensil receiving recess, the recessed edge portion defined by an edge portion of the peripheral edge and a plurality of opposed capture points, wherein the recessed edge portion is defined within a shape that is defined by the peripheral edge of the service item.

Preferably, the recessed edge portion is further defined by a portion of the peripheral edge that substantially follows the shape of the indentation that defines the utensil receiving recess, thus creating an open arc portion along with the plural capture points. More preferably, the plural capture points are opposed to one another from opposed sides of the recessed edge portion. The service item can also be provided in combination with a utensil including a portion thereof that is dimensioned to be supported on the edge portion defining the recessed edge portion adjacent to the opposed capture points.

DETAILED DESCRIPTION

Figure 1:
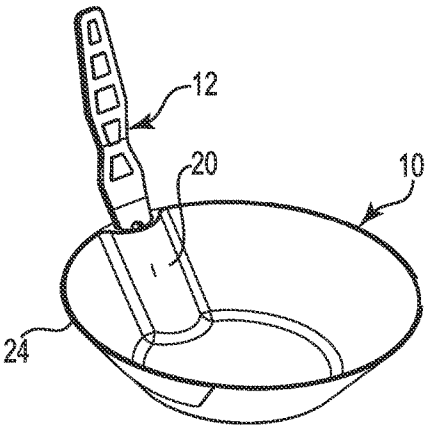
FIG. 1 is a perspective view of an embodiment of a food service item and utensil combination in accordance with the present invention, the utensil being supported at an intermediate point along the utensil and within a recessed edge portion of a bowl and at least partially positioned within a utensil receiving recess of the bowl.

The present invention is directed to the provision of a variety of food service items that have features for efficiency of the food provision to consumers and that are presentable for a variety of food service situations. In particular, food service items of the present invention comprise plastic materials for durability and presentation purposes.

In an embodiment, containers and food service items of the present invention are made from plastics that can be injection molded (i.e. made by forcing molten plastic into a prefabricated mold by pressure). In an embodiment, the containers and service items of the present invention can be manufactured by other plastic forming techniques than injection molding. Any plastic forming technique can be utilized, such as vacuum forming, thermoforming, molding, cast molding, blow molding, and other well-known molding and/or machining techniques. Plastic service items of the present invention can also be made by a 3D printing process, including fused deposition modeling, selective laser sintering, or selective heat sintering, as examples.

For purposes of the present invention, a plastic material is "recyclable" if it can be re-used and/or recovered as discussed in the Guidelines for the recovery and recycling of plastics waste set forth in ISO 15270:2008. Recyclable materials may be obtained from petroleum sources or from "bio-based" sources, i.e. primarily from plant or animal based sources.

For purposes of the present invention, a "Biodegradable Plastic" is a degradable plastic in which the degradation results from the action of naturally occurring microorganisms such as bacteria, fungi and algae.

For purposes of the present invention, an "Industrially Compostable Plastic" is a plastic that undergoes degradation by biological processes during composting in a municipal or industrial aerobic composting facility to yield $CO_2$, water, inorganic compounds and biomass at a rate consistent with other compostable materials and leaves no visible, distinguishable or toxic residue as set forth in ASTM D6400.

For purposes of the present invention, a "{number} Day Garden Compostable Plastic" is a plastic that undergoes degradation by biological processes to yield $CO_2$, water, inorganic compounds and biomass and leaves no visible, distinguishable or toxic residue within an identified number of days after placement in conventional garden soil at temperatures of from about 65° to 75° F. A "360 Day Garden Compostable Plastic" is a plastic wherein the degradation takes place within 360 days. A "180 Day Garden Compostable Plastic" is a plastic wherein the degradation takes place within 180 days. A "90 Day Garden Compostable Plastic" is a plastic wherein the degradation takes place within 90 days. A "45 Day Garden Compostable Plastic" is a plastic wherein the degradation takes place within 45 days.

In preferred embodiments, the containers and service items of the present invention are prepared from injection moldable materials. This embodiment provides substantial benefits in ease and economy of manufacture.

In an embodiment of the present invention, the containers and service items of the present invention are prepared from a thermoforming Plastic. In an embodiment of the present invention, the containers and service items of the present invention are prepared from a vacuum forming Plastic. In an embodiment of the present invention, the containers and service items of the present invention are prepared from a blow molding Plastic. In an embodiment of the present invention, the containers and service items of the present invention are prepared from a cast molding Plastic. In an embodiment of the present invention, the containers and service items of the present invention are prepared from a rotational molding Plastic. In an embodiment of the present invention, the containers and service items of the present invention are prepared from a spin casting Plastic. In an embodiment of the present invention, the containers and service items of the present invention are prepared from a compression moldable Plastic. In an embodiment of the present invention, the containers and service items of the present invention are prepared from a machinable Plastic. Plastics can be machined by many different techniques including CNC machining processes of many types.

In an embodiment, the containers and service items of the present invention are prepared from recyclable material. Examples of such materials are polyethylene terephthalate (PET), polyvinyl chloride (PVC), high-density polyethylene (HDPE), low-density polyethylene (LDPE), polypropylene (PP), polystyrene (PS), polycarbonate and acrylonitrile butadiene styrene (ABS).

In an embodiment, the recyclable material is made from "bio-based" sources. In an embodiment, the material is a biobased, recyclable polyethylene material such as Green PE™ from Braskem, Philadelphia, Pa., or under the brand Terralene® from FKuR Kunststoff GmbH, Willich, Germany. In an embodiment, the material is a biobased, recyclable polyethylene terephthalate material such as GLOBIO™ from FKuR Kunststoff GmbH, Willich, Germany. In an embodiment, the material is a biobased, recyclable polyamid material such as VESTAMID® Terra from FKuR Kunststoff GmbH, Willich, Germany.

In an embodiment, the Biodegradable Plastic is an Industrially Compostable Plastic. In an embodiment, the Biodegradable Plastic is a 360 Day Garden Compostable Plastic. In an embodiment, the Biodegradable Plastic is a 180 Day Garden Compostable Plastic. In an embodiment, the Biodegradable Plastic is a 90 Day Garden Compostable Plastic. In an embodiment, the Biodegradable Plastic is a 45 Day Garden Compostable Plastic. In an embodiment, the Biodegradable Plastic is a 30 Day Garden Compostable Plastic. In an embodiment, the Biodegradable Plastic is a 20 Day Garden Compostable Plastic. In an embodiment, the Biodegradable Plastic is a 15 Day Garden Compostable Plastic.

In an embodiment, the Biodegradable Plastic comprises a polymer selected from the group consisting of polylactic acid polymer, polyhydroxyalkanoate polymer, starch based resin, cellulose esters, biobased polyethylene compounds, and mixtures thereof.

In an embodiment, the Biodegradable Plastic comprises polylactic acid polymer. Polylactic acid polymer (or "PLA") is derived from a sugar source such as corn, cellulosic raw materials, agricultural wastes and non-food plants. PLA polymers are described, for example, in U.S. Pat. No. 5,798,436, the disclosure of which is incorporated herein by reference. A PLA is sold under the brand name Ingeo™ by NatureWorks LLC. In an embodiment, the Biodegradable Plastic is a blend of co-polyester and PLA, optionally with additional natural fillers and the like. Such blends are commercially available under the name BIO-FLEX® from FKuR Kunststoff GmbH, Willich, Germany.

In an embodiment, the Biodegradable Plastic comprises polyhydroxyalkanoate polymers (PHAs) such as those sold under the brand Mirel™ resins from Metabolix, Cambridge Mass., and polyhydroxy-butyrate-co-valerate (PHBV) resins from TianAn® Biologic Material Co., Zhejiang, China.

In an embodiment, the Biodegradable Plastic comprises injection moldable cellulosic resins sold under the brand BIOGRADE® injection moldable cellulosic from FKuR Kunststoff GmbH, Willich, Germany.

In an embodiment, the Biodegradable Plastic comprises co-polymerizable components, such as soy proteins. Suitable soy proteins include soy protein concentrates (SPCs) and soy protein isolates (SPCs), which are commercially available from Solae Company, St. Louis, Mo.

In an embodiment, the Biodegradable Plastic comprises an organic filler material, such as polyethylene glycol, glycerol, zein, corn starch, distillers dry grains with solubles, and mixtures thereof. In an embodiment, the Biodegradable Plastic comprises an organic filler material that is distillers dry grains with solubles ("DDGS"), such as a DDGS sold under the brand BioRes™ by Laurel Biocomposite LLC.

In an embodiment, the Biodegradable Plastic comprises an inorganic filler material, such as nanoclays.

In an embodiment, the containers and service items are made from material comprising natural fiber reinforcement such as wood fiber. An example of such a reinforced injection moldable material is Fibrolon® material from FKuR Kunststoff GmbH, Willich, Germany.

It will be appreciated that the skilled artisan is capable of adjusting the length of time required for biodegradation of biodegradable containers and service items of the present invention by selection of the dimensions of the item (e.g. including relative thickness of portions of the item) and/or incorporating varying amounts or organic filler, reactive species and enzymes that hasten the biodegradation of the material.

One embodiment of a food service item is illustrated within FIGS. 1-4 that includes a plastic disposable bowl 10 in combination with a utensil 12, wherein the utensil 12 is operatively supported by the bowl 10 in a manner that allows the utensil 12 to be presented along with the bowl 10. Such a bowl 10 and utensil combination can be presented with food provided within the bowl 10 for ready consumer consumption, or the bowl 10 and utensil combination can be provided to be accessed by a consumer for the consumer to load with food. Advantageously, a food server would not have to separately supply the bowl 10 and utensil 12 so that a consumer would have to associate them. The food, bowl 10 and utensil can advantageously be presented together in combination to the consumer. Also in accordance with aspects of the present invention, utensils can be sanitarily provided without the need to be provided in separate packaging. Food service items of the present invention also permit unused or used utensils to be stored by the food service item at any time so that the consumer need not otherwise have to store the utensil while doing other things such as during socializing with others. For example, a consumer could store a utensil 12 to the bowl 10 after partially consuming food while greeting another person at a reception type event for a temporary period, if desired.

Figure 6:
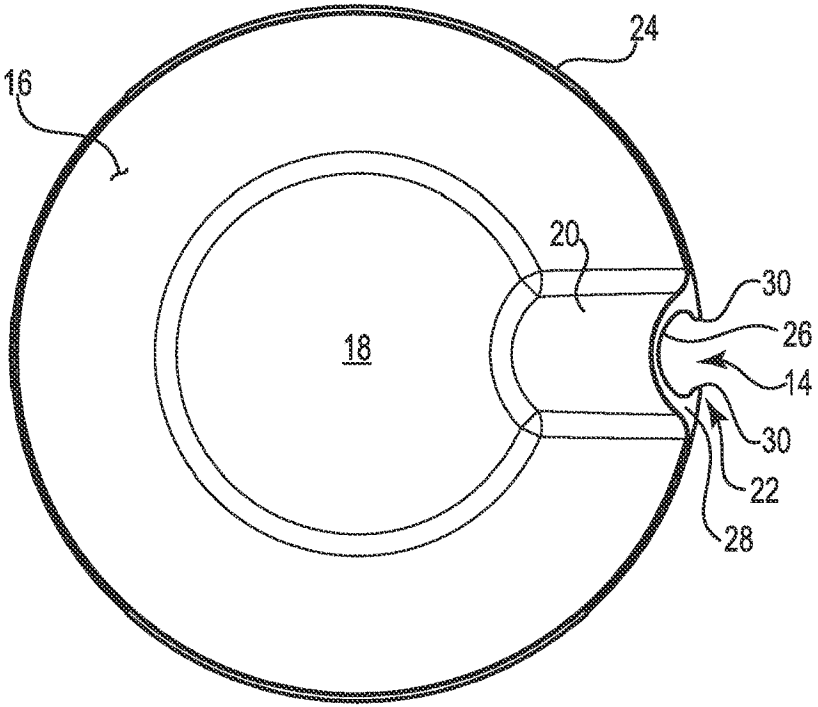
FIG. 6 is a top view of the recessed edge portion of FIG. 5.
Figure 5:
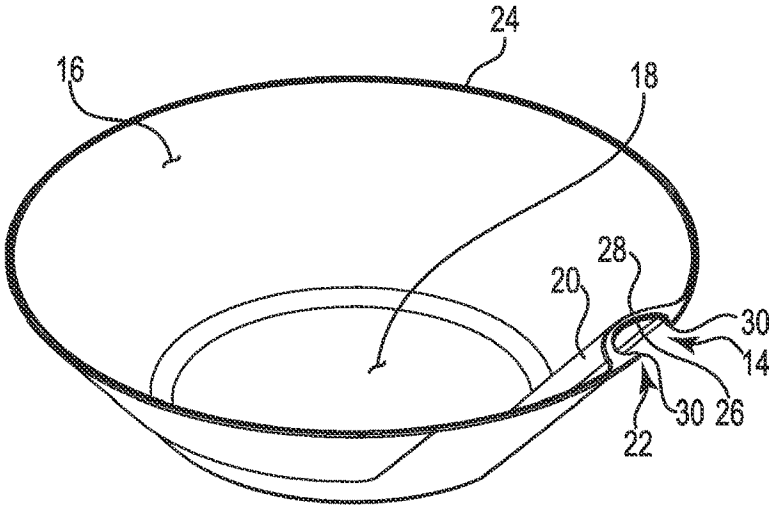
FIG. 5 is perspective view of the bowl of FIG. 1 showing features of the recessed edge portion in accordance with the present invention.
Figure 8:
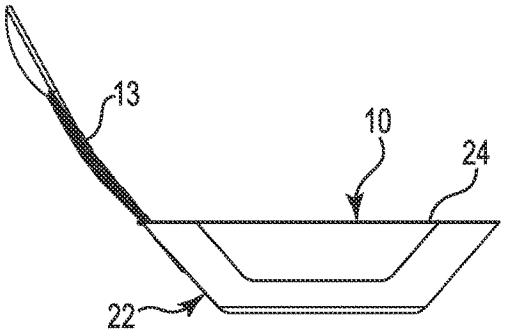
FIG. 8 is a side view similar to FIG. 2, but with the spoon supported from a handle end portion of the utensil like in FIG. 7.
Figure 10:
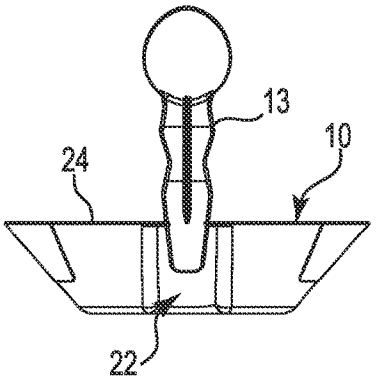
FIG. 10 is a side view similar to FIG. 4, but with the spoon supported from a handle end portion of the utensil like in FIG. 7.
Figure 7:
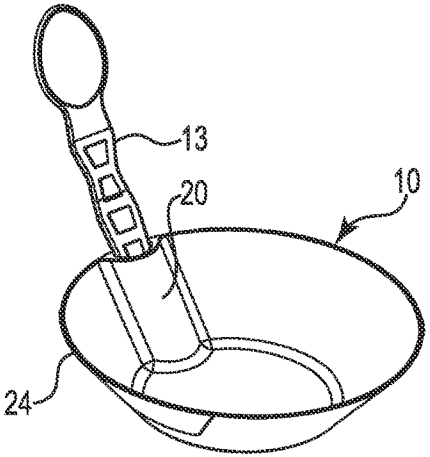
FIG. 7 is a perspective view similar to FIG. 1 but with a spoon supported to the bowl with the spoon supported from a handle end portion of the utensil.
Figure 9:
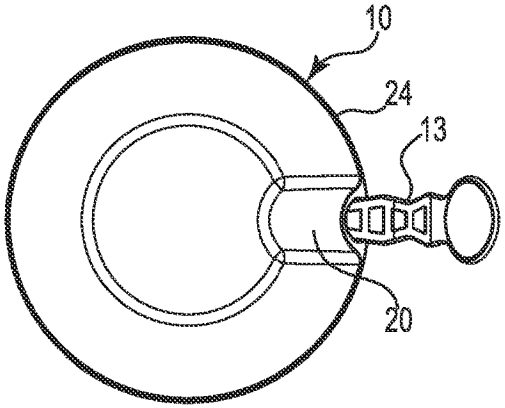
FIG. 9 is a top view similar to FIG. 3, but with the spoon supported from a handle end portion of the utensil like in FIG. 7.

In FIGS. 5 and 6, the bowl 10 is illustrated without the utensil 12. As shown, a utensil hanging feature 14 is provided along a portion of the periphery of the bowl 10, which in this example is a circular bowl as viewed from a top view, FIG. 6. Whereas the bowl 10 comprises a sidewall 16, which in this embodiment defines a substantially truncated cone, along with a bottom 18, the utensil hanging feature 14 comprises an indentation 20 of the sidewall 16. Preferably, the indentation 20 generally follows the inside bowl surface but as a convex surface portion or bump of the inside bowl surface. The advantage of providing the indentation 20 is that a utensil receiving recess 22 can thus be formed along the bowl outside surface.

Along the top peripheral edge 24 of the bowl 10, a recessed edge portion 26 is aligned with the utensil receiving recess 22 so as to provide access to the recess 22 from above the bowl 10 and to provide a support functionality for a utensil 12. Specifically, the recessed edge portion 26 is defined by a portion 28 of the peripheral edge 24 that substantially follows the shape of the indentation 20, thus creating an open arc portion. Preferably also, capture points 30 are provided as part of the peripheral edge 24 and that extend beyond the edge portion 28 and thus beyond the utensil receiving recess 22 from opposed sides of the recess 22. This structure advantageously provides a functional utensil support aspect to the utensil hanging feature 14 based upon utensil design, as discussed in detail below.

Figure 2:
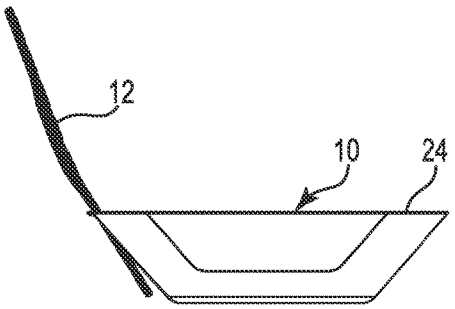
FIG. 2 is a side view of the bowl and utensil combination of FIG. 1 showing the utensil supported to be completely above a bottom surface of the bowl so that the bowl and utensil combination can be set on a flat support surface without obstruction.
Figure 4:
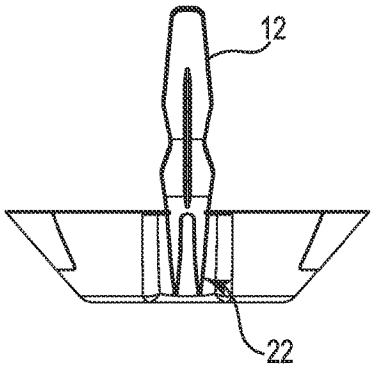
FIG. 4 is a side view of the bowl and utensil combination of FIG. 1 showing a pick utensil partially positioned within the utensil receiving recess of the bowl.

By the construction described above, a utensil 12 can be supported by the recessed edge portion 26 and partially received within the utensil receiving recess 22. By controlling the design of the utensil 12, as described below, a portion of the utensil 12 can be received within the utensil receiving recess 22 below the peripheral edge 24 of the bowl 10 with a portion of the utensil 12 above the peripheral edge 24. As shown in FIGS. 2 and 4, a preferable position of the utensil 12 relative to the bowl 10 is where the utensil is supported so that it extends less than the height of the bowl 10. As such, a bowl 10 as supported on a horizontal surface can be combined with a utensil 12 with the utensil supported in a position also above the horizontal surface. Preferably, all or a substantial portion of the utensil 12 portion below the peripheral edge 24 as the utensil is hung from the recessed edge portion 26 can be positioned within the utensil receiving recess 22 created by the indentation 20.

It is contemplated that any such utensil 12 can be supported by the recessed edge portion 26 with any degree of the utensil 12 extending below the recessed edge portion 26 and at least partially positioned within the utensil receiving recess 22. As described below, any number of features can be designed into the shape of the utensil handle portion to create support points along the utensil handle for the purpose. A single utensil design can incorporate any number of support locations along its length allowing a consumer to place and replace the utensil 12 to the service item, such as the bowl 10, any number of times at any number of different locations as may be spaced along the utensil handle.

Moreover, it is also preferable that the recessed edge portion 26 be provided within the peripheral shape of the bowl 10, as defined by the peripheral edge 24 including a projection portion thereof at the recessed edge portion 26. That is to say, that with a circular bowl top view shape, the recessed edge portion 26 preferably is positioned within the circular top shape of the bowl. Service items of the present invention can be of any shape, but it is preferred that with any selected shape, the recessed edge portion be positioned within that overall shape as viewed from the top or bottom as a matter of a preferred presentation. That aspect along with the lower utensil portion being positioned within the utensil receiving recess 22 provides a presentation aspect of the bowl 10 and utensil 12 combination of the present invention.

Figure 3:
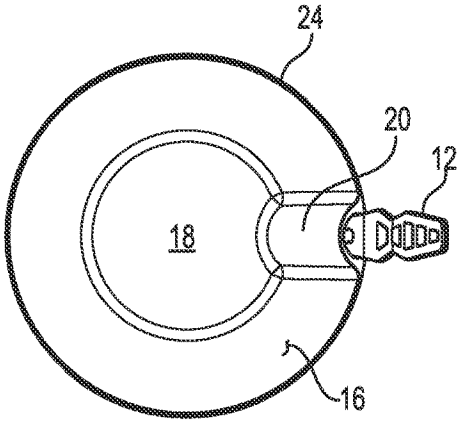
FIG. 3 is a top view of the bowl and utensil combination of FIG. 1 showing the utensil as supported within a recessed edge portion that lies within a shape defined by a peripheral edge of the bowl.

FIGS. 1 and 3 illustrates how a utensil 12 is supported within the recessed edge portion 26 of the bowl 10 so that only a portion of the utensil 12 above the peripheral edge 24 lies outside of the top circular shape of the bowl 10. At the bowl height and below, the utensil lies within that top circular shape of the bowl 10. The portion of the utensil 12 below the bowl height need not be positioned fully within the utensil receiving portion 22, as shown in FIG. 2, as the utensil 12 will hang naturally based upon its balance as it is hung within the recessed edge portion 26 and captured within that recessed edge portion 26 with the help of capture points 30. With sufficient weighting of the portion of the utensil 12 above the bowl peripheral edge 24, the lower utensil can be caused to assume a position within an adequately sized and shaped utensil receiving recess 22. The capture points 30 provide a support point that allows the utensil 12 to pivot relative to the peripheral edge 24 with the bottom of the utensil 12 (the bottom being determined by the position of the utensil 12 relative to the bowl 10, not the utensil itself) urged toward the outside bowl surface within the indentation 20.

For example, in FIGS. 7-10, a utensil 13 is illustrated supported to the bowl 10 with a lower portion of the utensil 13 substantially within the utensil receiving recess 22. This occurs with a larger weight portion of the utensil 13 (in this case the operative portion of a spoon) above the peripheral edge 24 so that the upper portion weight causes the utensil 13 to pivot about the capture points 30 and thus the peripheral edge 24 to urge the lower utensil portion (the handle portion of a spoon) toward and potentially against the outside surface of the indentation 20 of the bowl 10.

Figure 12:
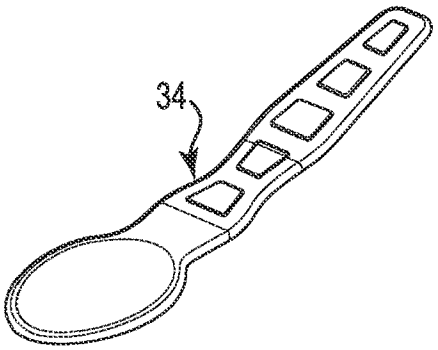
FIG. 12 is a perspective view of a spoon utensil including features allowing the utensil to be supported by a recessed edge portion of the present invention as provided in a food service item.
Figure 11:
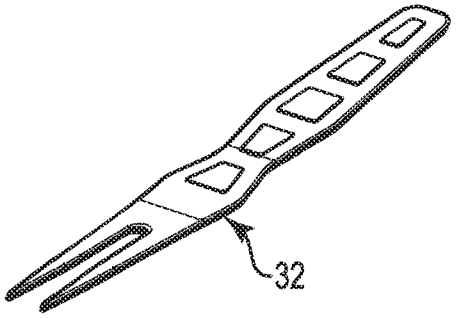
FIG. 11 is a perspective view of a pick utensil including features allowing the utensil to be supported by a recessed edge portion of the present invention as provided in a food service item.

In FIGS. 11-14, examples of utensils usable in accordance with combinational aspects of the present invention are illustrated. Specifically, in FIG. 11, a pick utensil 32 is shown as may be usable, for example, to spear or dig at food items. In FIG. 12, a spoon 34 is shown and in FIG. 13, a fork 36 is shown. In each of the case of the pick 32, spoon 34, and fork 36, an important aspect in the combinability with a bowl 10 of the present invention is the design of one or more support portions of the handle portion of the pick 32, spoon 34, or fork 36 that are wider in transverse dimension than the open dimension of the recessed edge portion 26 at its widest point. Preferably, the widest point of the open area of the recessed edge portion 26 is provided just adjacent to the capture points 30 as they opposed one another so that the utensil will be supported within the open area and adjacent to the capture points 30 to pivot as described above relative to the peripheral edge 24 of the bowl 10.

Figure 14:
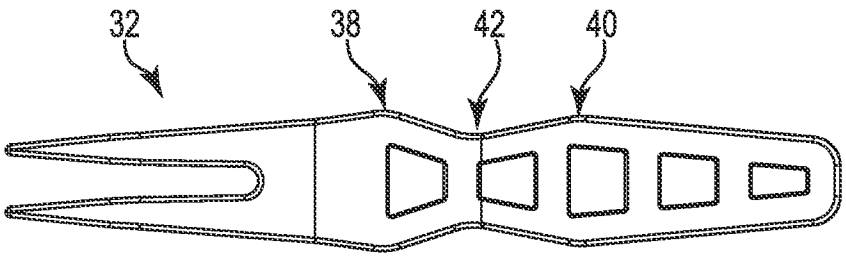
FIG. 14 is a top view of the fork utensil of FIG. 13 showing plural tapered or shaped edge portions creating relatively wider and narrower points along the length of the utensil to allow for the utensil to be supported in plural different ways to a recessed edge portion of a food service item in accordance with the present invention.

With reference to FIG. 14, the pick 32 is illustrated as having plural transverse wide portions 38 and 40 separated from one another by a narrow transverse portion 42. The transverse wider portion or portions 38 and 40 are dimensioned to be at least slightly greater than the widest dimension of the recessed edge portion 26 so that the pick 32 can be supported by the edge portion 28 and capture points 30 of the recessed edge portion 26 at either side of the wider portions 38 and 40. For example, if the right side of the pick 32 as shown in FIG. 14 is inserted from the top of the bowl 10 into the recessed edge portion 26, a portion of the pick 32 just to the right of the wider point 40 would contact the edge portion 28 adjacent the capture points 30 of the recessed edge portion 26. The portion of the pick 32 to the left of the wider portion 40 would thus be supported above the peripheral edge 24 of the bowl 10. Similarly, if the left side of the pick 32 were inserted from above through the recessed edge portion 26, a portion of the pick just to the left of the wider point 38 would contact the edge portion 28 that is adjacent to the capture points 30 of the recessed edge portion 26. The portion of the pick 32 to the right of the wider point 38 would thus be supported above the peripheral edge 24 of the bowl 10. If only a single wider point is provided to a utensil, the same would be true as that described above except that the support points of the utensil would be to either side of the one wider point.

Figure 13:
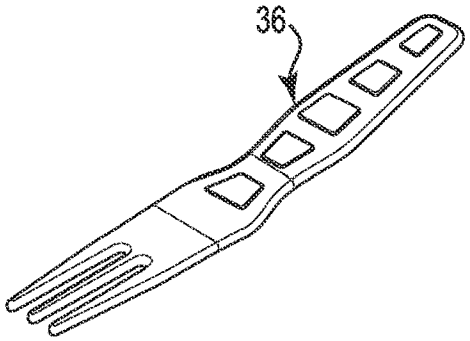
FIG. 13 is a perspective view of a fork utensil including features allowing the utensil to be supported by a recessed edge portion of the present invention as provided in a food service item.

By providing a relatively narrow portion 42 between plural wider points 38 and 40, support points can be also provided adjacent to the wider points 38 and 40 on either side of the narrow portion 42. So long as the transverse dimension of the narrow point 42 is small enough to allow the narrow point 42 to be moved through the dimension between the capture points 30 of the recessed edge portion 26, the utensil can be supported to the edge portion 28 by the inside portions of wider points 38 and 40 depending on which orientation the utensil is provided relative to the recessed edge portion 26. This allows multiple positions of a utensil relative to a food service item, such as the bowl 10 and/or other various food service items described and suggested below. This can be beneficial for supporting a utensil within the height of the service item, as noted above, or otherwise. Any number of wider points (as described above relative to the recessed edge portion dimension) can be provided to increase this flexibility. FIGS. 12 and 13, respectively, illustrate a spoon 34 and fork 36 with similar features as that described above with respect to the pick 32 for being supported and combined similarly with a service item, such as the bowl 10 described above. It is contemplated that with a service item, any number of recessed edge portions 26 and indentations 20 can be provided to facilitate any number of utensils about the periphery of the service item and that the utensils can be similarly or dissimilarly combined and supported to the service item.

Figure 26:
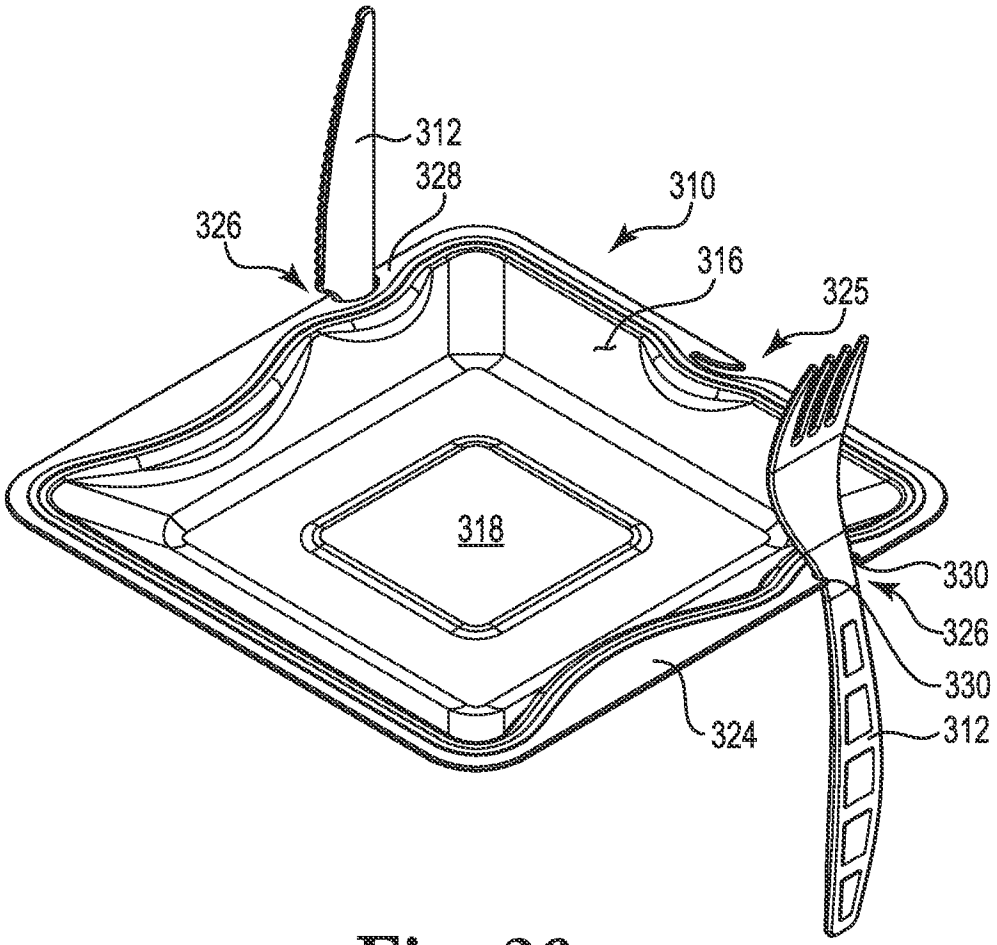
FIG. 26 is a perspective view of the food service plate of FIG. 24 but with the utensils supported so as to hang below a bottom surface of the food service plate.

Utensils of different sizes are contemplated in accordance with the present invention. For example, regular or customary sized utensils can be supported to a food service item so long as they are provided with at least one wider point (described above), preferably so as to permit the utensil to be supported without extending below a bottom surface of the food service item. For example, having a tapered portion of a utensil leading to a point wider than the widest dimension of the open area of the recessed edge portion 26 near the handle end of a utensil would suffice for the purpose of setting the food service item and utensil onto a support surface. Such is illustrated within FIG. 24 and discussed below. Or, such a customary sized utensil can be supported below the food service item bottom surface as shown in FIG. 26 and discussed below, such as while a consumer is standing or walking around with the food service item. Mini or smaller than customary sized utensils are also specifically contemplated, such as shown in FIGS. 1-4, 7-16, and 19-22, which can be supported and resupported in any number of the different ways discussed above. Preferably, with any utensil of the present invention, it is possible to hang the utensil at a mid-point, as described above, and at near a handle end of the utensil so as to allow a consumer to choose how to support the utensil to the food service item depending on any given situation. I the situation where a consumer is standing and holding a food service item, it may be preferable to have one or more utensils supported so as to hang mostly below the food service item, such as shown in FIG. 26, as discussed below.

In FIGS. 15-20, another service item is illustrated comprising a pedestal bowl 110 having a martini glass shape as may be used to serve various appetizer and/or desert foods. This bowl 110 comprises a sidewall 116 providing a frustoconical shape leading to a small bottom 118. This bowl 110 is similar to the bowl 10 described above, but with sharper angle to the sidewall 116 and a smaller bottom 118. Also, a pedestal 113 is shown as being either removably connected with or formed with the bowl 110, as known.

Figure 16:
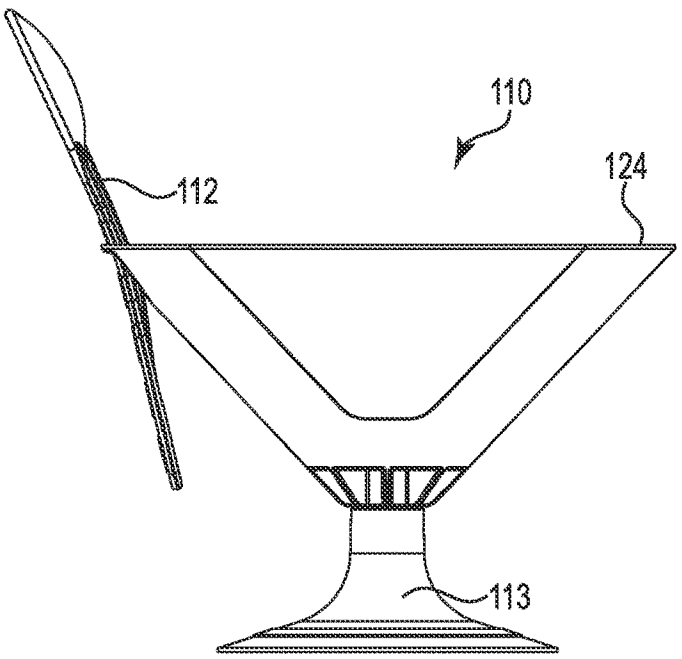
FIG. 16 is a side view of the pedestal bowl of FIG. 15 with the utensil supported above the bottom surface of the pedestal portion of the food service item.
Figure 15:
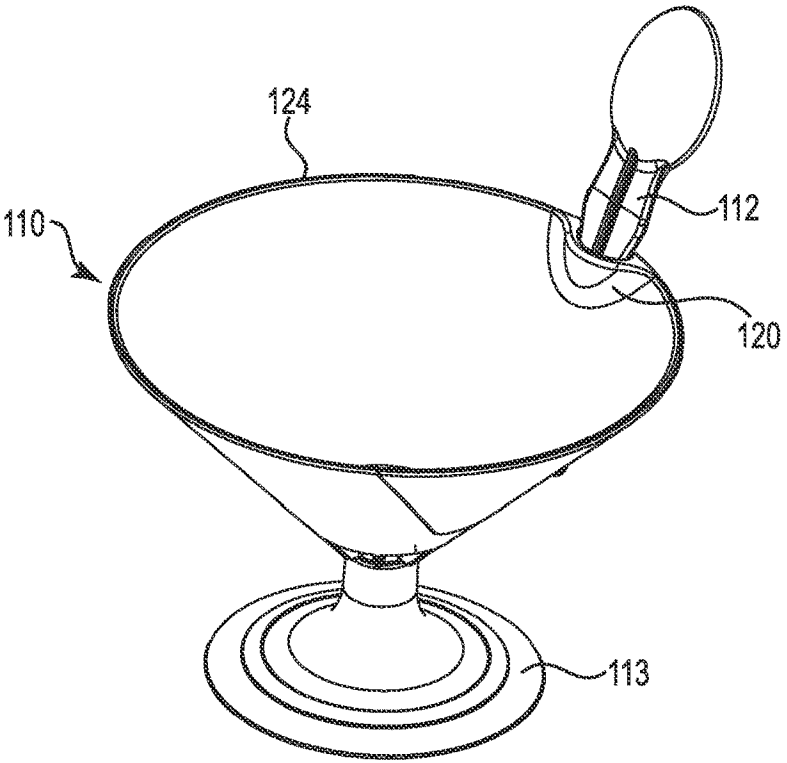
FIG. 15 is a perspective view of a pedestal bowl having a recessed edge portion supporting a utensil at an intermediate point along the utensil in accordance with the present invention.
Figure 18:
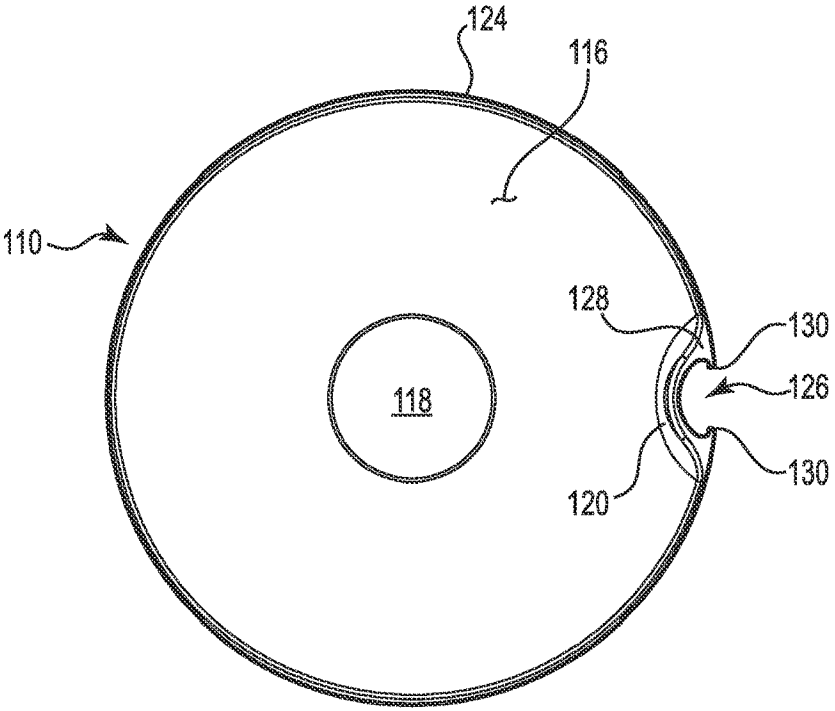
FIG. 18 is a top view of the pedestal bowl of FIG. 17.
Figure 17:
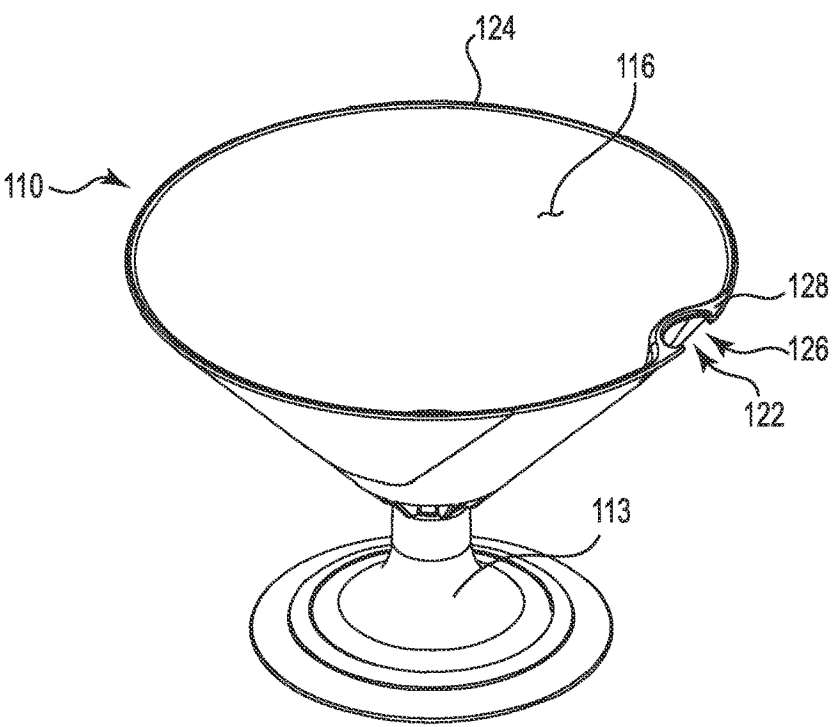
FIG. 17 is a perspective view of the pedestal bowl of FIG. 15 without the utensil showing features of the recessed edge portion in accordance with the present invention.

A utensil 112, in this case a spoon, is combined with the bowl 110 as shown in FIGS. 15 and 16 as such utensil 112 is supported by an edge portion 128 of a peripheral edge 124 of the bowl 110, which edge portion 128 is formed to create a recessed edge portion 126 with plural opposed capture points 130. The recessed edge portion 126 is shown as similar to the recessed edge portion 26, described above. However, a distinction is provided as to the formation of the indentation 120 and thus the utensil receiving recess 122. With the angle of the sidewall being sharper, the utensil 112 can be supported and facilitated as it hangs with a smaller indentation that extends only partially over the width of the sidewall 116 as compared with the indentation 20 of the bowl 10 that extends over the entire sidewall 16 width.

Figure 20:
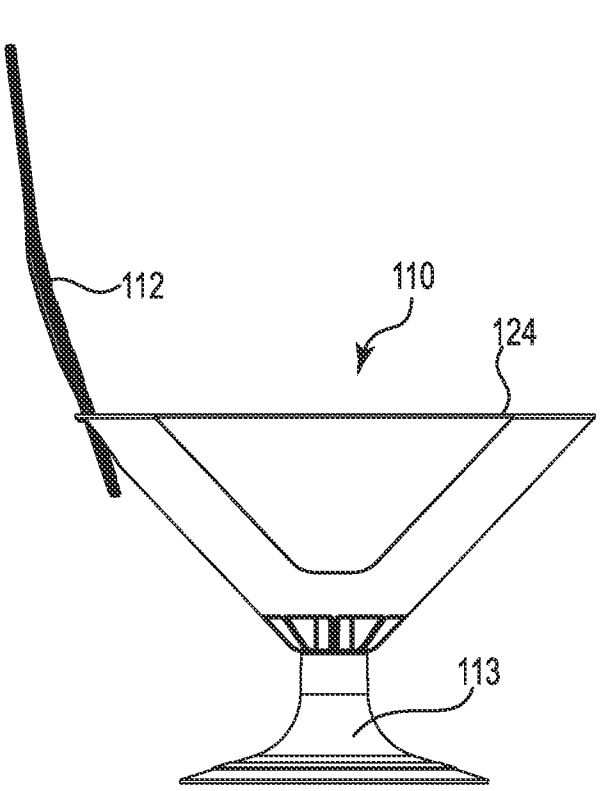
FIG. 20 is a side view of the combination of FIG. 19.
Figure 19:
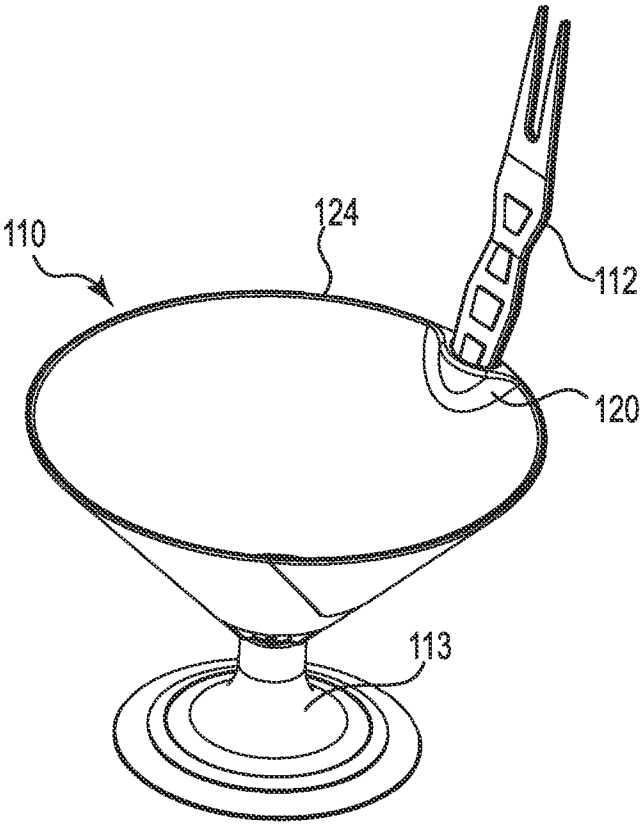
FIG. 19 is a view similar to FIG. 15 but with a utensil supported near a handle end of the utensil to the pedestal bowl.

Also, with the provision of the pedestal 113, the bowl 110 sits higher from any surface on which the bowl 110 and pedestal 113 are placed. This allows the design to accommodate a utensil 112, as shown that is supported, such as at a narrow portion 42, described above, so that a greater portion of the utensil 112 hangs below the peripheral edge 124 than with the bowl 10. The utensil can be otherwise supported in any number of other ways as well based upon the design of the handle portion of the utensil itself. This embodiment illustrates variations to the bowl design, the indentation size and shape and utensil supports aspects of the present invention. FIGS. 19 and 20 are similar to FIGS. 15 and 16 but show a utensil 112 supported differently with a greater portion of the utensil supported above the peripheral edge 124 and only a small portion of the utensil hanging below the peripheral edge 124. This illustrates how different service presentations are possible with the same utensil or a different utensil utilizing aspects of the present invention described above with respect to the utensil design and service item features including a recessed edge portion 126 of the present invention.

Figure 22:
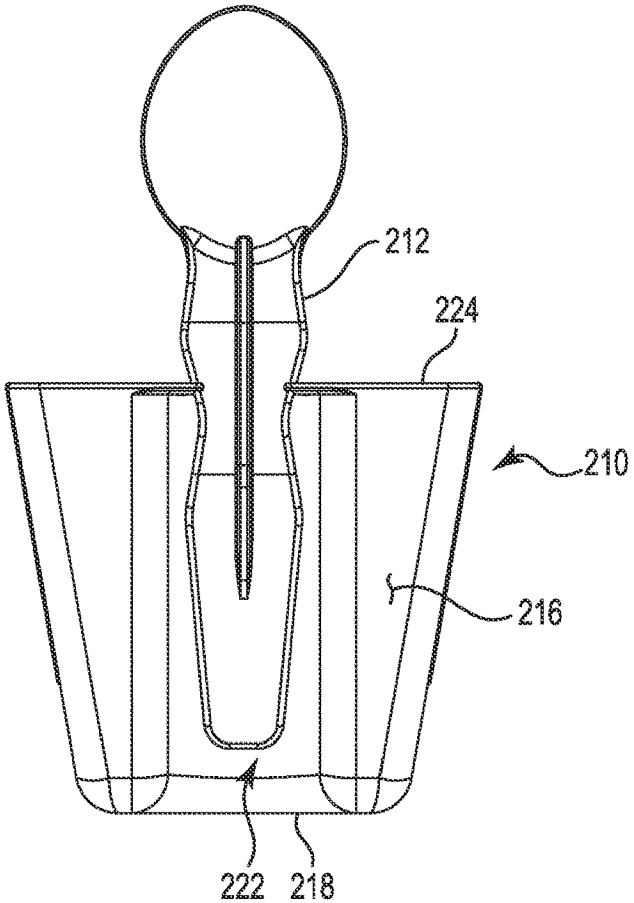
FIG. 22 is a side view of the combination of FIG. 21 showing the utensil supported above a bottom surface of the tapered rectangular bowl.
Figure 21:
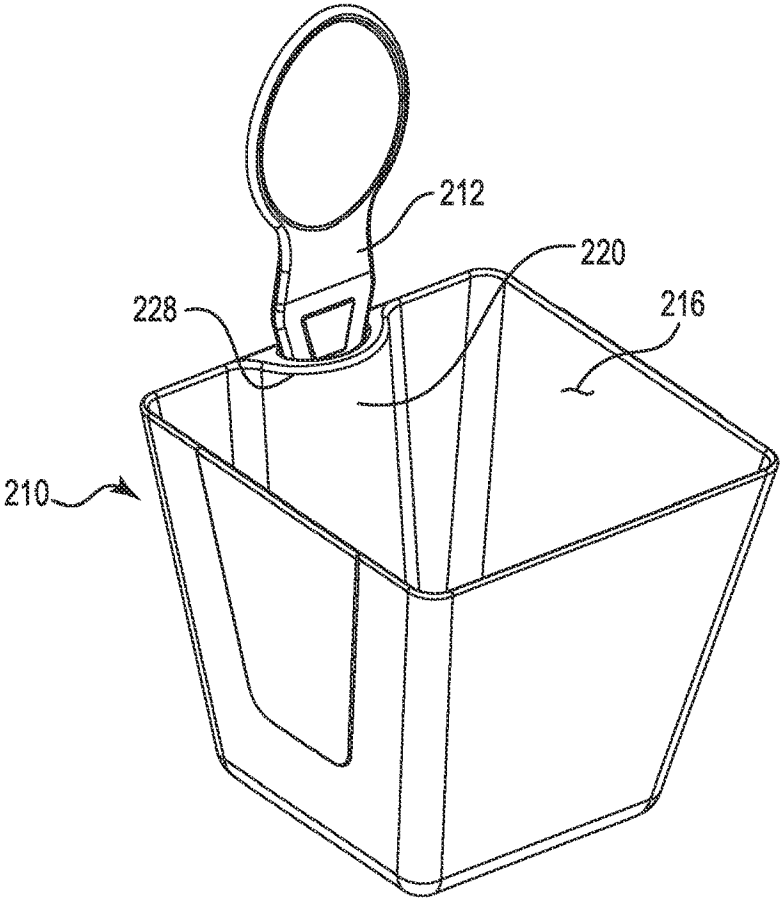
FIG. 21 is a perspective view of a tapered rectangular bowl combined with a utensil at an intermediate point along the utensil.
Figure 23:
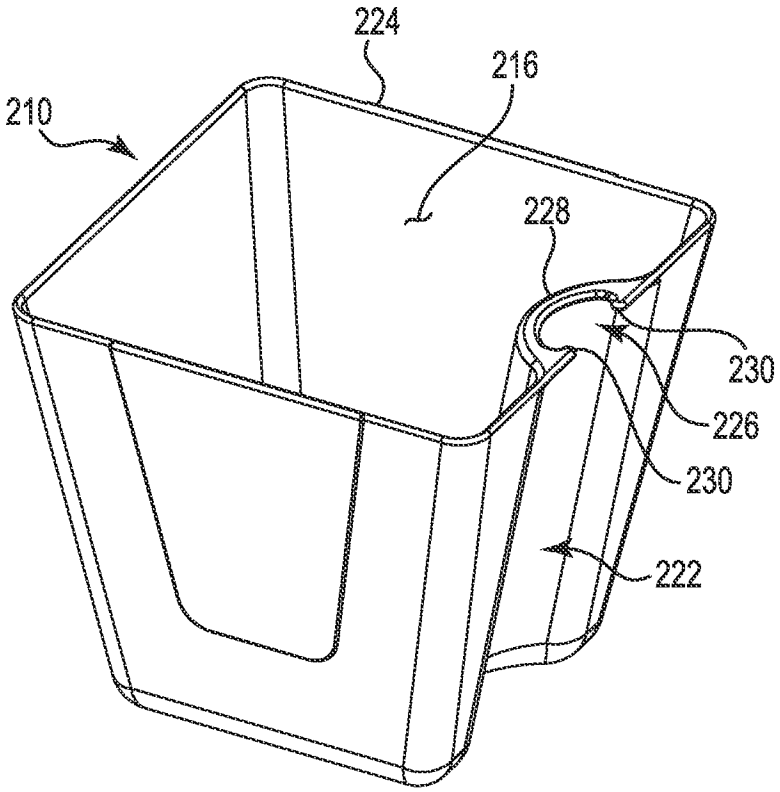
FIG. 23 is a perspective view of the tapered rectangular bowl of FIG. 21 without the utensil showing features of the recessed edge portion in accordance with the present invention.

FIGS. 21-23 shows another embodiment of a service item illustrated as a tapered rectangular bowl 210 comprising plural sidewall portions 216 and a bottom 218. Otherwise, the bowl 210 is similar to the bowl 10, described above, including an indentation 220 that extends over the width of one sidewall portion 216 so as to create a utensil receiving recess 222 that can receive a portion of a supported utensil 212 over the entire width of the sidewall portion 216, which preferably corresponds to the height of the bowl 210. Also, a recessed edge portion 226 is provided for supporting the utensil 212, as above, as defined by an edge portion 228 and opposed capture points 230. As above, the utensil 212 is preferably supported within the shape of the rectangular service item. FIG. 22 shows the utensil 212 supported within the recessed edge portion 226 with a lower portion thereof below the peripheral edge 224 and positioned within the utensil receiving recess 222. This embodiment illustrates variations to the bowl design, indentation design, and utensil support. Also, illustrated is a utensil support arrangement where a narrow portion of the utensil 212 would be moved through the opening into the recessed edge portion 226 between the capture points 230 and then supported adjacent to a relatively wider utensil point, as described above, by lowering the utensil 212 to be supported. The utensil 212 can just as easily be supported with the operative portion of the spoon down by orienting the spoon in that way and moving it into a support position to the recessed edge portion 226 similarly. The spoon would be supported by a portion of the spoon handle adjacent to the narrow portion to the other side thereof. If one or more other relatively narrow portions are provided along the length of the spoon handle, each narrow point can provide the ability to support the spoon to either side thereof depending of the spoon orientation. Also, as above, such a support point can be provided from an end of the handle to provide a support point from but a single orientation of the utensil.

Figure 25:
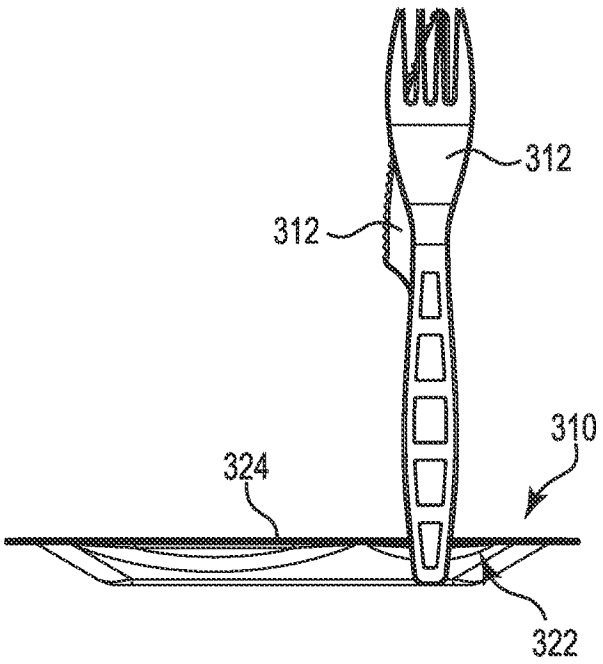
FIG. 25 is a side view of the combination of FIG. 24 showing the utensil supported above a bottom surface of the food service plate.
Figure 24:
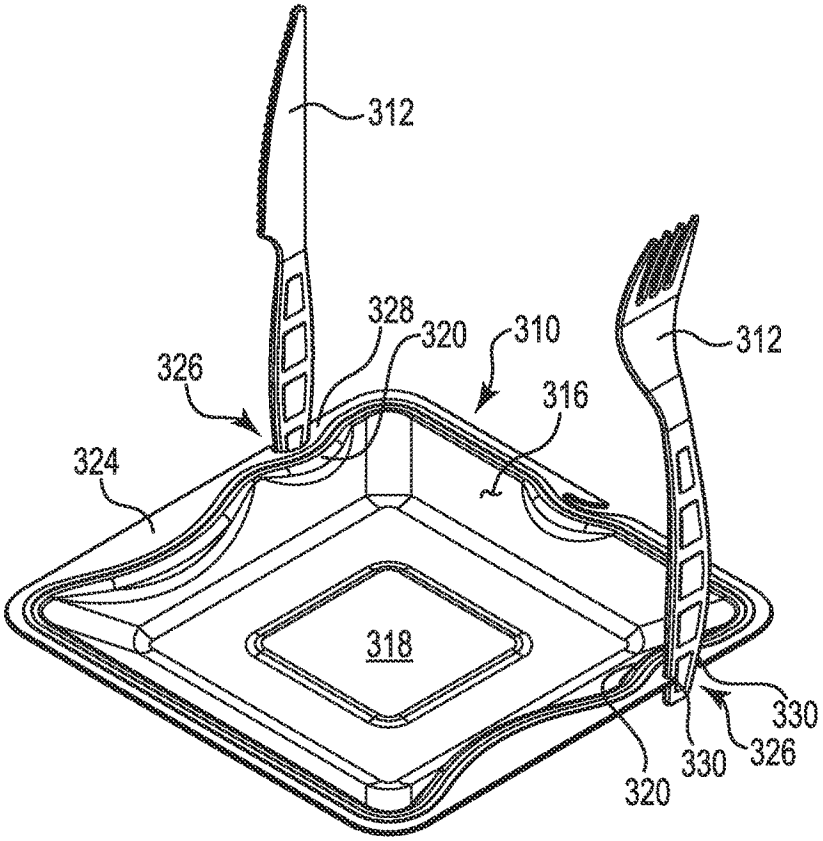
FIG. 24 is a perspective view of a food service plate with surrounding sidewalls combined with plural utensils as such are supported with recessed edge portions in accordance with the present invention.

In FIGS. 24-26, yet another variation to a service item is illustrated with various presentations of a combination of a service plate 310 and plural utensils 312. The service plate 310 is shown as comprising plural sidewall portions 316 and a bottom 318. The service plate 310 also includes plural indentations 320 that extend over a portion of the width of plural different sidewall portions 316 so as to create plural utensil receiving recesses 322 that each can receive a portion of a supported utensil 312. Also, plural recessed edge portions 326 are provided for supporting the utensils 312, similarly as above, with each recessed edge portion 326 being defined by an edge portion 328 and opposed capture points 330. This variation of the present invention illustrates that any number of recessed edge portions 326 can be provided along a peripheral edge, as such edge may be defined as an edge or along a wider rim, as shown. The wider rim allows the recessed edge portions 326 to be formed therein so only a small indentation can be utilized for providing a smaller utensil receiving recess 322. It is further contemplated that any number of recessed edge portions 326 can be provided to one or more sides of the service item, such as the plate 310 or any of the bowls or other items described or suggested herein.

A comparison of FIGS. 24 and 26 illustrate how utensils 312 can be differently supported within a similar recessed edge portion 326. In FIGS. 24 and 25, the utensils 312 are fully supported by the recessed edge portions 326 with the majority of the utensils 312 supported above the peripheral edge 324. Only a very small portion of the utensils 312 are positioned within the utensil receiving recess 322 below the peripheral edge 324. According to the utensil design as described above, the lower portion of the utensil can be accommodated with the service plate 310 provided on a horizontal surface. In FIG. 26, the utensils 312 are illustrated as supported at a different utensil location so that the majority of the utensils 312 are positioned below the peripheral edge 324 so as to mostly hang below the service plate 310 with a portion of each utensil 312 positioned along the utensil receiving recesses 322. Various service plate and utensil combinations are shown providing distinct presentation possibilities. Additional features are also contemplated as can be provided to any of the service items of the present invention, such as a napkin slot 325, as shown in FIG. 26 within which a napkin can be inserted and held.

Figure 29:
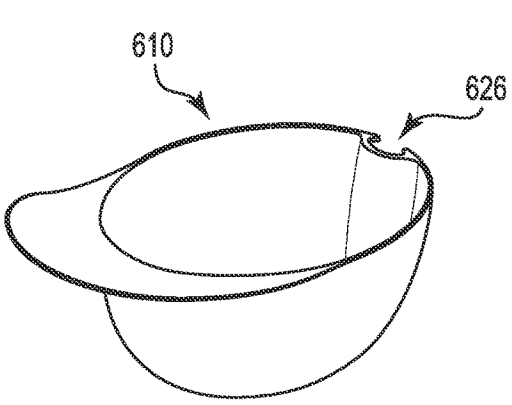
FIG. 29 is a perspective view of a novelty service item that can include one or more recessed edge portions as may be provided in any number of ways based upon a desired combination presentation in accordance with the present invention.
Figure 28:
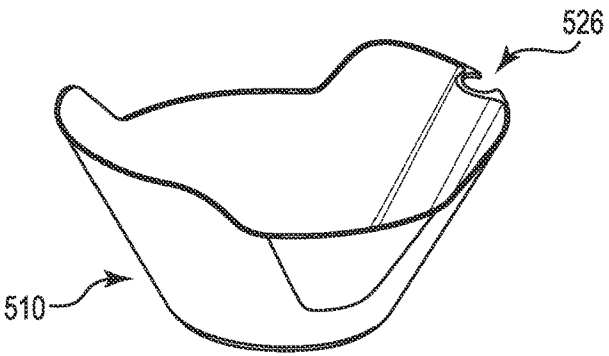
FIG. 28 is a perspective view of a bowl that includes plural higher peripheral edge portions, one of which is provided with a utensil supporting recessed edge portion.
Figure 27:
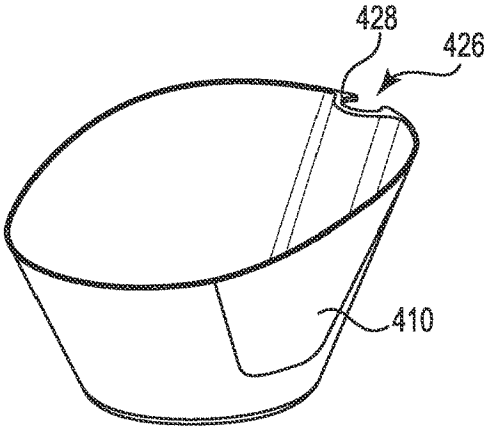
FIG. 27 is perspective view of a bowl having a recessed edge portion that is provided along an edge portion of a peripheral edge that is of a greater height than the rest of the peripheral edge showing that the peripheral edge can be varied to accommodate a desired presentation including a utensil presentation.
Figure 31:
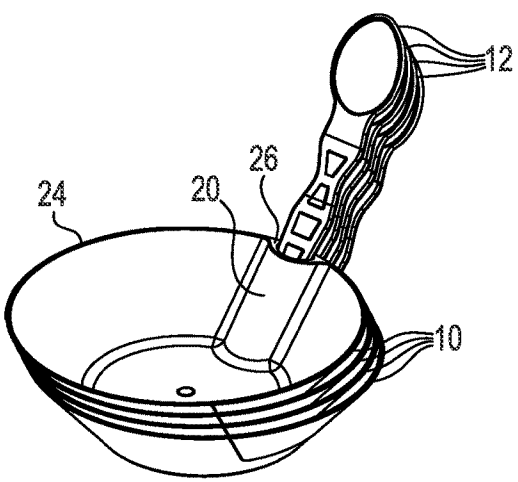
FIG. 31 is a perspective view of the stack of food service items and utensils as combined with one another of FIG. 30.
Figure 33:
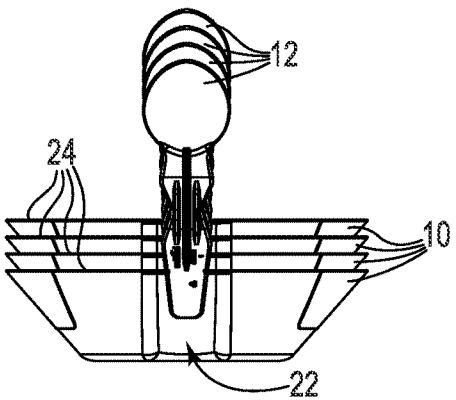
FIG. 33 is another side view of the stack of food service items and utensils as combined with one another of FIG. 30 showing the positioning of a portion of a utensil within the utensil receiving recess of the bottom bowl.
Figure 30:
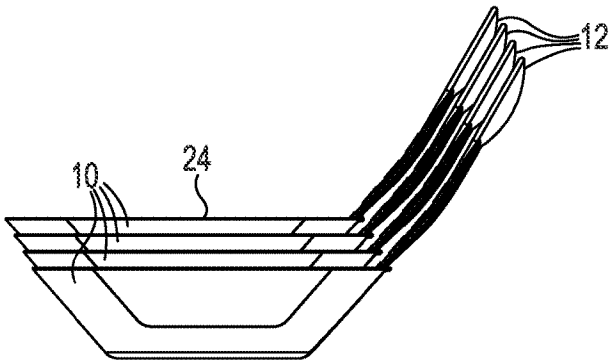
FIG. 30 is a side view of a stack of food service items as combined with a utensil with the utensils supported within a recessed edge portion of each food service item and with the utensils in substantially similar orientation to one another.
Figure 32:
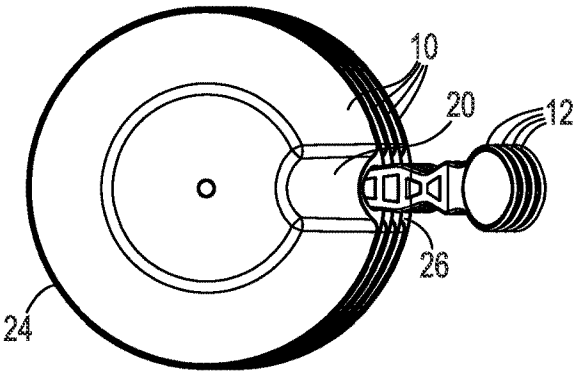
FIG. 32 is a top view of the stack of food service items and utensils as combined with one another of FIG. 30 showing the similar orientation of each utensil to one another.
Figure 35:
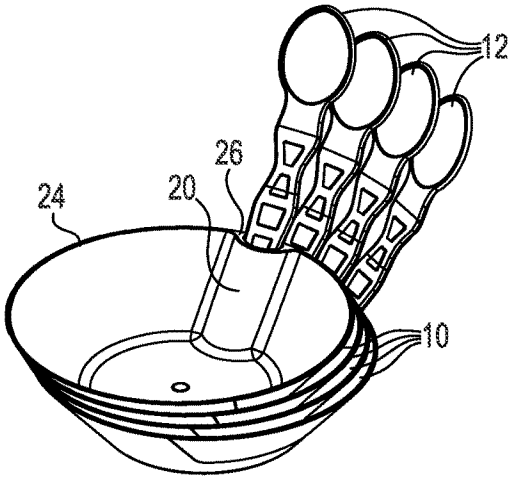
FIG. 35 is a perspective view of the stack of food service items and utensils as combined with one another of FIG. 34.
Figure 37:
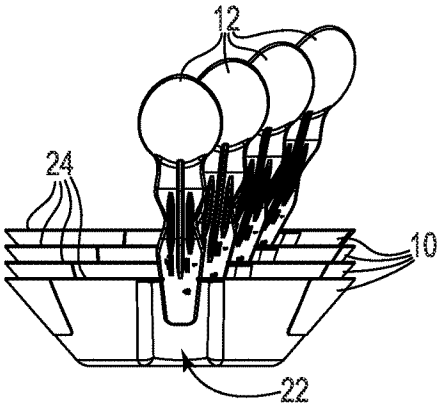
FIG. 37 is another side view of the stack of food service items and utensils as combined with one another of FIG. 34 showing the positioning of a portion of a utensil within the utensil receiving recess of the bottom bowl.
Figure 34:
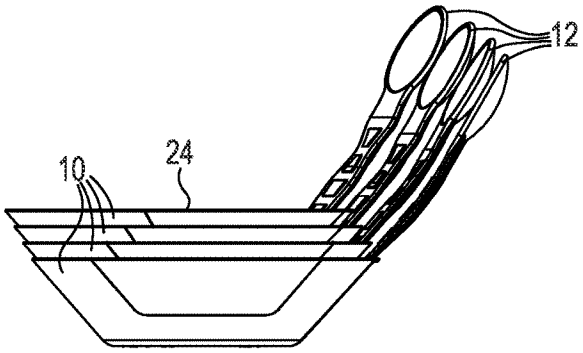
FIG. 34 is a side view of a stack of food service items as combined with a utensil with the utensils supported within a recessed edge portion of each food service item and with the utensils dissimilarly oriented with respect to one another.
Figure 36:
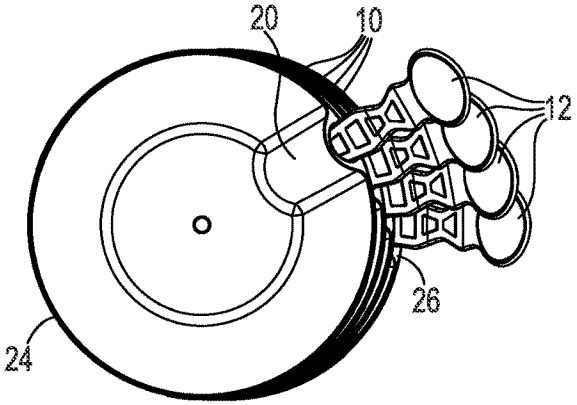
FIG. 36 is a top view of the stack of food service items and utensils as combined with one another of FIG. 34 showing the dissimilar orientation of each utensil to one another.

Other variations are illustrated within FIGS. 27, 28, and 29. A bowl 410 is shown in FIG. 27 having a recessed edge portion 426 that is similar to those described above and that is provided along an edge portion 428 of a peripheral edge 424 that is of a greater height than the rest of the peripheral edge 424. This variation shows and suggests that the peripheral edge 424 can be varied to accommodate a desired presentation including a utensil presentation. This would allow bowl with an effectively low volume to support a utensil mostly below the peripheral edge and provides a unique combination service item and utensil presentation. The bowl 510 illustrated in FIG. 28 is similar but includes plural higher peripheral edge portions, one of which is provided with a utensil supporting recessed edge portion 526. Any number of higher edge portions are contemplated, any of which can include a recessed edge portion 526, as desired for a presentation of combined service items and utensils. In FIG. 29, a novelty service item is shown at 610 that can include one or more recessed edge portions 626 as may be provided in any number of ways based upon a desired combination presentation.

By the descriptions above with respect to many different food service items and utensils and variations of both, it is apparent that many different food service presentations are available. Food service items can be of virtually any shape preferably provided with one or more recessed edge portions 26 that can support a utensil in any number of ways depending on a presentation preference. For a desert, for example, a bowl or cup can be provided with the food dispensed therein and with the utensil provided ready to go with the food as supported to the bowl or cup. The utensil can be presented depending on its orientation and the desired support point chosen along its length, as also described above. For other foods including soups and the like, other presentations might be desirable including one or more utensils.

Food service items may be otherwise provided without food dispensed thereon or in but in accordance with the present invention can be set out or displayed in combination with one or more utensils to be ready for use by a consumer. Such an arrangement might be useful for a buffet line of any kind of food where the consumer first picks up a service item and utensil combination as can be provided in close proximity to the food.

A manner of providing plural food service items in the form of bowls 10, similar to those described above, is shown in FIGS. 30-33. Specifically, a stack of bowls 10 is illustrated as may be provided at a point of usage for consumers to pick a bowl 10 and utensil 12 combination. As shown, each bowl 10 is preferably combined with a utensil as the stack of bowls 10 are presented. In this illustrated stack of bowls 10, a spoon as the utensil 12 is provided handle-down within a recessed edge portion 26 of each bowl 10. More specifically, each utensil 12 is shown supported at a midpoint along each handle portion so that the handle portion of each utensil 12 extends below the bowl's peripheral edge 24 but not below the bowl's bottom 18.

The handle portion that is below the peripheral edge 24 of each bowl/utensil combination preferably is substantially located within the utensil receiving recess 22, discussed above, for each bowl 10 as provided by the indentation 20 of each bowl 10. This allows a unique presentation for each bowl/utensil combination by stacking them, such as with the utensils 12 in substantial alignment with one another. The bowls 10 sit slightly offset to one another as stacked due to the size of the indentation 20 forming each utensil receiving recess 22, which offset provides sufficient space for the utensil handles as provided within the utensil receiving recesses 22 of each bowl 10 of the stack even as the utensils 12 are in alignment. The provision of the utensil receiving recess 26 of each bowl 10 within the area of the overall bowl's circular shape facilitates this unique stacking. This aspect can be incorporated into food service items of any shape, as discussed above as well.

FIGS. 34-37 show another stack of bowls 10 in combination with utensils 12. This stack is substantially similar to that described above with respect to the stack in FIGS. 30-13 but with the bowls shown dissimilarly oriented with respect to one another. Specifically, the bowls 10 are shown slightly rotated with respect to one another to create a stepped bowl and utensil combination presentation. Like the FIGS. 30-33 version, the stack of bowls accommodates a portion of each utensil handle within the utensil receiving recess of each bowl 10 with the offset between bowls 10 creating space between adjacent bowls 10. This manner of stacking can be continued with any number of bowls 10 to create from the utensils 12 a look of a partial spiral or a spiral having any number of loops. As above, stacking of any shaped food service items in combination with one or more utensils can be done to create many different presentations.

By the service items of the present invention, many variations of combinations of the service items and utensils are possible. Not only do the combinations of the present invention make service more efficient by combining a service item with needed utensil(s), any number of different service presentations can be accommodated with utensils supported at various positions for distinct looks.

The invention claimed is:

1. A service item and utensil combination for presentation of foods along with the combination, the combination comprising:

the service item having at least a side wall defining an inside surface creating a food receiving volume, the service item having a height, the side wall having an indentation that extends at least partially over a width of the sidewall for defining a utensil receiving recess along an outside surface of the sidewall, and a recessed edge portion provided along a peripheral edge of the sidewall providing access to the utensil receiving recess, the recessed edge portion defined by an edge portion of the peripheral edge and a plurality of opposed capture points that are also parts of the peripheral edge, the capture points being aligned to provide a utensil pivot axis; and the utensil including a hanging portion thereof that is dimensioned to be at least slightly greater than a widest dimension of the recessed edge portion so as to allow the utensil to be supported on and hung from the edge portion defining the recessed edge portion adjacent to the opposed capture points, and the utensil being pivotally supportable by the opposed capture points and having a portion extending from the hanging portion that is sized so that the utensil can be hung from the recessed edge portion without extending from the recessed edge portion more than the height of the service item and that is pivotal about the utensil pivot axis toward the utensil receiving recess.

2. The service item and utensil combination of claim 1, wherein the recessed edge portion is defined within a shape that is defined by the peripheral edge of the service item.

3. The service item of claim 2, wherein the recessed edge portion is further defined by a portion of the peripheral edge that substantially follows the shape of the indentation that defines the utensil receiving recess, thus creating an open arc portion along with the plural capture points.

4. The service item of claim 3, wherein the plural capture points are opposed to one another from opposed sides of the recessed edge portion.

5. The service item of claim 1, wherein the item is prepared from an injection moldable material.

6. The service item of claim 1, wherein the item is prepared from a recyclable material.

7. The service item of claim 1, wherein the item is prepared from an injection moldable Biodegradable Plastic.

8. The service item of claim 7, wherein the injection moldable Biodegradable Plastic is an Industrially Compostable Plastic.

9. The service item of claim 7, wherein the injection moldable Biodegradable Plastic is a 360 Day Garden Compostable Plastic.

10. The service item of claim 7, wherein the injection moldable Biodegradable Plastic is a 90 Day Garden Compostable Plastic.

11. The service item of claim 7, wherein the injection moldable Biodegradable Plastic comprises an injection moldable polymer selected from the group consisting of polylactic acid polymer, polyhydroxyalkanoate polymer, starch based resin, cellulose esters, biobased polyethylene compounds, and mixtures thereof.

12. The service item of claim 7, wherein the injection moldable Biodegradable Plastic comprises polylactic acid polymer.

13. The service item of claim 7, wherein the injection moldable Biodegradable Plastic comprises a polyhydroxyalkanoate polymer.

14. A method of presenting a plurality of food service items and utensils in combination with one another, the method comprising the steps of:

providing a first food service item having at least a side wall defining an inside surface for receiving food, the side wall having an indentation that extends at least partially over a width of the sidewall for defining a utensil receiving recess along an outside surface of the sidewall, and a recessed edge portion provided along a peripheral edge of the sidewall providing access to the utensil receiving recess, the recessed edge portion defined by an edge portion of the peripheral edge and a plurality of opposed capture points that are also parts of the peripheral edge, the capture points being aligned to provide a utensil pivot axis;

supporting a first utensil by way of a portion thereof that is dimensioned at least slightly greater than a widest dimension of the recessed edge portion so as to be supported on the edge portion defining the recessed edge portion adjacent to the opposed capture points of the first food service item and allowing the first utensil to pivot about the utensil pivot axis of the first food service item;

providing at least a second similar food service item having at least a side wall defining an inside surface for receiving food, the side wall having an indentation that extends at least partially over a width of the sidewall for defining a utensil receiving recess along an outside surface of the sidewall, and a recessed edge portion provided along a peripheral edge of the sidewall providing access to the utensil receiving recess, the recessed edge portion defined by an edge portion of the peripheral edge and a plurality of opposed capture points that are also parts of the peripheral edge, the capture points being aligned to provide a utensil pivot axis;

supporting a second utensil by way of a portion thereof that is dimensioned at least slightly greater than a widest dimension of the recessed edge portion so as to be supported on the edge portion defining the recessed edge portion adjacent to the opposed capture points of the second food service item and allowing the second utensil to pivot about the utensil pivot axis of the second food service item; and stacking the second food service item while it supports the second utensil onto the first food service item while it supports the first utensil.

15. The method of claim 14, wherein the supporting steps each comprise supporting the utensil so that a portion thereof is positioned within the utensil receiving recess of the respective first and second bowls.

16. The method of claim 15, wherein the stacking step comprises orienting at least one food service item dissimilarly with respect to the orientation of at least one other food service item.

* * * * *